United States Patent [19]

Firey

[11] 3,995,606

[45] Dec. 7, 1976

[54] GASOLINE ENGINE TORQUE REGULATOR WITH SPEED CORRECTION

[76] Inventor: Joseph Carl Firey, 1554 N.E. 95th St., Seattle, Wash. 98115

[22] Filed: Feb. 2, 1976

[21] Appl. No.: 654,572

[52] U.S. Cl. ..... 123/90.12; 123/90.15; 123/90.16

[51] Int. Cl.[2] ..... F01L 9/02

[58] Field of Search ..... 123/90.12, 90.16, 90.13, 123/90.15

[56] References Cited

UNITED STATES PATENTS

| | | | |
|---|---|---|---|
| 885,459 | 4/1908 | Engler | 123/90.12 |
| 1,965,517 | 7/1934 | Vitalini | 123/90.16 |
| 2,065,081 | 12/1936 | Lee | 123/90.12 |
| 3,257,999 | 6/1966 | Figoler | 123/90.12 |
| 3,518,976 | 7/1970 | Thuesen | 123/90.16 |
| 3,738,337 | 6/1973 | Massie | 123/90.12 |
| 3,817,228 | 6/1974 | Bywater | 123/90.16 |
| 3,938,483 | 2/1976 | Firey | 123/90.16 |

*Primary Examiner*—Wendell E. Burns
*Assistant Examiner*—Daniel J. O'Connor

[57] ABSTRACT

The gasoline engine torque regulator described herein provides means of reducing the quantities of harmful oxides of nitrogen emitted via the exhaust of a four stroke cycle gasoline engine and also of increasing the efficiency of the engine at part load, with an engine torque characteristic either approximately constant with engine speed or alternatively controllably decreasing with increasing engine speed. These beneficial objects are achieved by adjustably delaying the closing of the engine intake valve as a means of controlling the engine torque, the opening of the intake valve remaining fixed. This manner of intake valve opening and closing can be achieved by adding to the conventional intake valve operating mechanism a dashpot device with a check valve and a positive displacement flow regulator. The check valve allows ready flow of the dashpot fluid between dashpot chambers when the intake valve is being opened but closes and forces fluid to flow oppositely, during intake valve closing, at least partially via the positive displacement flow regulator which proportions the flow and hence the rate of valve closure to the speed of the engine. With intake valve closing thereby delayed, a portion of the air-fuel mixture, drawn into the engine cylinder during the intake stroke, is pushed back into the intake manifold during the compression stroke. As a result less air-fuel mixture remains in the engine cylinder and the engine torque is reduced, the extent of such torque reduction increasing as the intake valve closing is longer delayed The engine compression ratio is reduced at reduced torque and, in consequence, gas temperatures during compression, combustion and expansion are reduced, producing a beneficial decrease in the quantities of oxides of nitrogen formed and subsequently emitted. Part load efficiency of the engine is increased because pumping work is essentially estimated.

4 Claims, 3 Drawing Figures

GASOLINE ENGINE TORQUE REGULATOR WITH SPEED CORRECTION

CROSS REFERENCE TO RELATED APPLICATIONS

This invention is a modification of the invention described in my earlier application entitled, "Gasoline Engine Torque Regulator", Ser. No. 536,969, filing date Dec. 23, 1974, now U.S. Pat. No. 3,938,483 Joseph Carl Firey, Inventor, for which a Notice of Allowance has been issued as of Oct. 30, 1975. The modification consists principally in providing means to proportion the rate of valve closing to the speed of the engine.

BACKGROUND OF THE INVENTION

1. Field of the Invention

This invention pertains to the field of four stroke cycle gasoline engines and specifically the field of means of regulating the torque of such engines by delaying the time of intake valve closing so as to achieve an approximate Atkinson cycle at part load in lieu of the conventional Otto cycle, as achieved by the use of an intake throttle for torque regulation.

2. Description of the Prior Art

The essential prior art is presented in the earlier application cross referenced above. When a dashpot is used, as described therein, to adjustably delay intake valve closure the engine torque will rise at fixed torque control setting when engine speed decreases. This engine characteristic of rising torque with decreasing speed is desirable in certain engine uses as for example, in earthmoving or agricultural machinery. In other engine uses, as for example, passenger automobile drives, such an engine torque characteristic is undesirable. For passenger automobile engines a constant torque or only slightly rising torque with decreasing speed is preferred as being the engine torque characteristic to which passenger car drivers are accustomed.

The gasoline engine torque regulator, described in the earlier application cross referenced above, connects a piston and cylinder dashpot between the engine intake valve and the engine frame. This dashpot is fitted with a check valve flow passage which opens fully during valve opening to allow free flow of dashpot fluid between chambers when the engine intake valve is being opened by the intake cam and valve linkage. When the engine intake valve is being closed by the action of the intake valve spring the check valve closes and return flow of dashpot fluid then takes place via an adjustable restricted flow passage. In this way the closing of the engine intake valve may be adjustably delayed, by adjustment of the restriction in the restricted flow passage, beyond the usual intake valve closing time of at or near piston bottom dead center. As intake valve closing is longer delayed an increasing portion of the air-fuel mixture drawn into the engine cylinder during the intake stroke is pushed back into the intake manifold as the piston rises during the compression stroke. The amount of air-fuel mixture thusly returned to the intake manifold is proportional to the delay of intake valve closure beyond piston bottom dead center expressed in engine crankshaft degrees or, equivalently, expressed in percent of piston return stroke. Hence engine torque, which is proportional to the amount of air-fuel mixture left in the engine cylinder at intake valve closure, must decrease in proportion to the crankshaft degrees of delay of such valve closure. Since the dashpot devices of my earlier referenced invention delay intake valve closure by a fixed time interval, at any one setting of the flow restriction, engine torque must increase as engine speed decreases since the delay interval in crankshaft degrees is necessarily decreased thereby.

SUMMARY OF THE INVENTION

A first principal object of this invention is to modify the dashpot device of the earlier cross-referenced application so that engine torque remains constant or nearly constant when engine speed changes at fixed setting of the torque regulator. This type of engine torque characteristic is preferred in certain uses of gasoline engines, as, for example, automobile uses. This first object is accomplished by replacing the adjustable flow restrictor of the earlier cross-referenced application with a variable stroke, positive displacement flow regulator actuated in proportion to engine speed. A second principal object of this invention is to modify the dashpot device of the earlier cross-referenced application so that the engine torque characteristic can be adjusted anywhere between constant torque with increasing engine speed to sharply decreasing torque with increasing engine speed. This second object is accomplished by placing a variable stroke, positive displacement flow regulator, actuated in proportion to engine speed, in parallel flow with the adjustable flow restrictor of the earlier cross-referenced application and disconnecting the torque control linkage from said adjustable flow restrictor. Said variable stroke, positive displacement flow regulator allows a fixed number of fluid portions to pass from one dashpot chamber to the other within a fixed angle of engine crankshaft rotation, the volume of each such portion being adjustable by adjustment of the stroke of the positive displacement flow regulator, such adjustment of stroke being the means of regulating the engine torque.

Other beneficial objects of this invention are the same as those described in detail in the earlier referenced application and include the following beneficial objects:

1. Reduction of exhaust emissions of undesirable oxides of nitrogen at part load by reduction of average and maximum combustion temperatures.

2. Reduction of exhaust emissions of undesirable carbon monoxide and unburned hydrocarbons by minimizing liquid fuel fraction maldistribution between the cylinders of a multicylinder engine.

3. Improvement of engine efficiency at part load by essentially eliminating the pumping work of the intake and exhaust processes of a four stroke cycle gasoline engine.

These latter beneficial objects are achieved by the same means as described in the earlier referenced application.

DETAILED DESCRIPTION OF THE INVENTION

Figure 1:
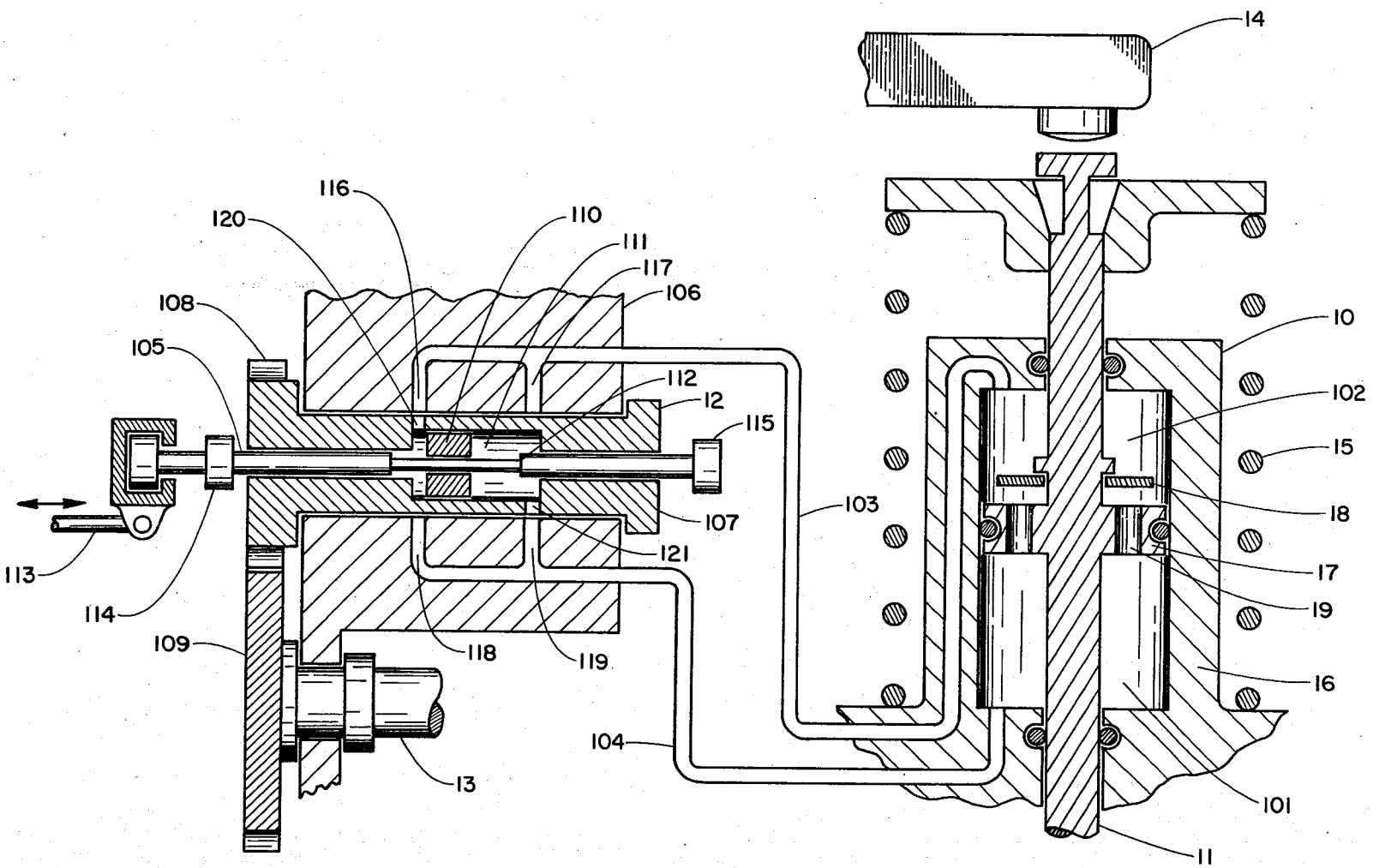
In FIG. 1 is shown one assembly arrangement of a dashpot element, 10, to an intake valve, 11, of a gasoline engine with a variable stroke, positive displacement flow regulator, 12, driven from an engine shaft, 13, such as the engine camshaft or crankshaft.

One preferred form of the invention is shown in FIG. 1 connected to a dashpot element, 10, which connects in turn to an engine intake valve, 11, said engine intake valve, 11, being actuated by the usual intake valve rocker arm, 14, or other final portion of the usual intake valve operating cams and linkage, and the usual intake valve closing spring, 15. The intake valve operating cams and linkage, including the rocker arm, 14, the intake valve closing spring, 15, and the engine intake valve, 11, are all parts of a conventional, four stroke cycle, gasoline engine whose other necessary operative portions, such as, cylinders, pistons, connecting rods, crankshafts, camshafts and camshaft drive gear, exhaust valves, etc., are not shown in the Figures and are already well known in the art of gasoline engines. The dashpot, 10, including the component parts, dashpot cylinder, 16, dashpot piston, 17, one way check valve, 18, and check valve flow passage, 19, are similar to the corresponding component parts described in the cross referenced earlier application. The operation of an engine intake valve equipped with such a dashpot is as follows. At the usual intake valve opening time of at or near engine piston top dead center at the start of the intake stroke, the intake valve cam moves the linkage, 14, to positively open the intake valve, 11, and the one way check valve, 18, opens fully allowing free flow of dashpot fluid through the check valve flow passages, 19, from the valve side, 101, of the piston, 17, to the rocker arm side, 102. Hence the opening of the engine intake valve is not affected by the dashpot element. At the usual intake valve closing time of at or near engine piston bottom dead center at the end of the intake stroke, the intake valve cam moves the linkage, 14, away from the intake valve, 11, in the closing direction and the engine intake valve, 11, is forced in the closing direction by the force of the intake valve closing spring, 15. The one way check valve, 18, then closes off the check valve flow passages, 19, and the dashpot fluid can only return from the rocker arm side, 102, of the dashpot piston, 17, to the valve side, 101, via the control passages, 103 and 104. Hence the rate of closing of the engine intake valve can be determined by the rate of flow of dashpot fluid through the control passages provided such rate of flow allows the engine intake valve to close more slowly than does the intake valve cam and linkage. The engine intake valve cannot close more quickly than allowed by the intake valve cam and linkage but can be closed adjustably more slowly by adjusting the rate of flow of the dashpot fluid through the control passage. In the earlier cross referenced application such adjustment of the rate of flow of the dashpot fluid was accomplished by placing in the control passage an adjustable flow restrictor such as a needle valve or viscous restrictor. These latter kinds of adjustable flow restrictor set a fixed time duration of intake valve closing for each setting of the flow restrictor. In consequence the engine crank angle duration of intake valve closing, and correspondingly the percent of piston return stroke during which the intake valve remains open, increases as engine speed increases. Thus at any fixed setting of such an adjustable flow restrictor the engine torque will decrease as engine speed is increased since engine torque is proportional to the amount of air-fuel mixture left inside the engine cylinder when the intake valve finally closes and this mixture amount necessarily decreases as the duration of the intake valve closing, as a percent of piston return strokes, is increased by increase of engine speed. Such an engine torque characteristic of sharply decreasing torque with increasing speed and rising torque with decreasing speed is suitable for certain gasoline engine uses, such as to earthmoving machines, but is less suitable for other gasoline engine uses, such as to passenger automobiles where a nearly constant torque with change of engine speed is preferred as being the torque characteristic to which automobile drivers have been long accustomed. For still other gasoline engine uses, such as medium and heavy trucks, an intermediate torque characteristic is desired.

A first principal object of this invention is to make available the several beneficial objects of the earlier cross referenced application for a gasoline engine having a nearly constant torque with change of engine speed. This first principal object of this invention is achieved by removing the adjustable flow restrictor from the control passage and placing therein, in its stead, a variable stroke, positive displacement flow regulator, whose design and operation are described hereinafter, so that dashpot fluid returns during valve closing from the rocker arm side, 102, of the dashpot piston, 17, to the valve side, 101, only via the positive displacement flow regulator, 12.

A second principal object of this invention is to make available the several beneficial objects of the earlier cross referenced application for a gasoline engine whose torque characteristic can be changed to a constant torque with changing engine speed or to a sharply decreasing torque with increasing engine speed or to any torque characteristic between these two. This second principal object of this invention is achieved by placing a variable stroke, positive displacement flow regulator, as described hereinafter, in parallel flow with the adjustable flow regulator of the earlier referenced application so that dashpot fluid returns during valve closing from the rocker arm side, 102, of the dashpot piston, 17, to the valve side, 101, via both the aforementioned adjustable flow restrictor and, in parallel therewith, the variable stroke, positive displacement flow regulator. The torque control linkage is disconnected from the adjustable flow restrictor and connected instead to the piston stop bar, 105, of the variable stroke, positive displacement flow regulator.

The variable stroke, positive displacement flow regulator, 12, comprises the following elements: a fixed port element, 106, within which rotates a rotating port element, 107, driven positively, as by gears, 108 and 109, or chain or timing belt, from the engine camshaft, 13, or crankshaft; a free piston element, 110, moveable within a closed end cylinder, 111, whose stroke within said cylinder is limited by a portion, 112, of the piston stop bar, 105; said piston stop bar, 105, being connected to the engine torque control linkage, 113, and being fitted with two control stops, 114 and 115, which limit how far the piston stop bar can be moved back and forth by the torque control linkage, 113. The full control stop, 114, positions the piston stop bar so that the free piston, 110, is free to move through its maximum full active displacement volume, VP, and the idle control stop, 115, positions the piston stop bar so that the free piston, 110, is free to move only through its minimum idle displacement volume, VI. The fixed port element, 106, contains four sets of fixed ports, two sets of pressure fixed ports, 116 and 117, and two sets of discharge fixed ports, 118 and 119, the two sets of pressure fixed ports, 116 and 117, connecting together to one portion, 103, of the control passage which connects into one end of the dashpot cylinder, 16, the two sets of discharge fixed ports, 118 and 119, connecting together to the other portion, 104, of the control passage which connects into the other end of the dashpot cylinder, 16. One set of pressure fixed ports, 116, is coplanar with one set of discharge fixed ports, 118, in a plane normal to the axis of rotation of the rotating port element, 107, and these fixed ports are also coplanar with one moving port, 120, in the rotating port element. The other set of pressure fixed ports, 117, is coplanar with the other set of discharge fixed ports, 119, in another plane normal to the axis of rotation of the rotating port element, 107, and these latter fixed ports are also coplanar with the other moving port, 121, in the rotating port element.

The moving port, 120, indexes alternately with those pressure fixed ports, 116, and those discharge fixed ports, 117, with which it is coplanar. The moving port, 121, indexes alternately with those discharge fixed ports, 119, and those pressure fixed ports, 117, with which it is coplanar. When the moving port, 120, is indexed with a pressure fixed port, 116, the other moving port, 121, is indexed with a discharge fixed port, 119. Subsequently the moving port, 120, will next index with a discharge fixed port, 118, and the other moving port, 121, will simultaneously next index with a pressure fixed port, 117. One method of obtaining this pattern of indexing between the moving ports and the fixed ports is as follows. An integral odd number of pressure fixed ports is contained in each of the two sets of pressure fixed ports, this odd number of pressure fixed ports in each coplanar set are angularly displaced relative to each other about the axis of rotation of the rotating port element, 107. The number of discharge fixed ports in each set of the two sets of discharge fixed ports is equal to the number of pressure fixed ports with which they are coplanar and this odd number of discharge fixed ports in each coplanar set are angularly displaced relative to each other about the axis of rotation of the rotating port element, 107, so that each discharge fixed port is displaced 180 degrees from one of the coplanar pressure fixed ports about said axis of rotation. Each pressure fixed port of one coplanar set of pressure and discharge fixed ports is angularly displaced from one discharge fixed port of the other coplanar set of pressure and discharge fixed ports by the displacement angle between the rotating ports. Said displacement angle is the angle between one moving port, 120, and the other moving port, 121, measured in the direction of rotation of the rotating port element, 107, and about the axis of rotation of said rotating port element.

Figure 2:
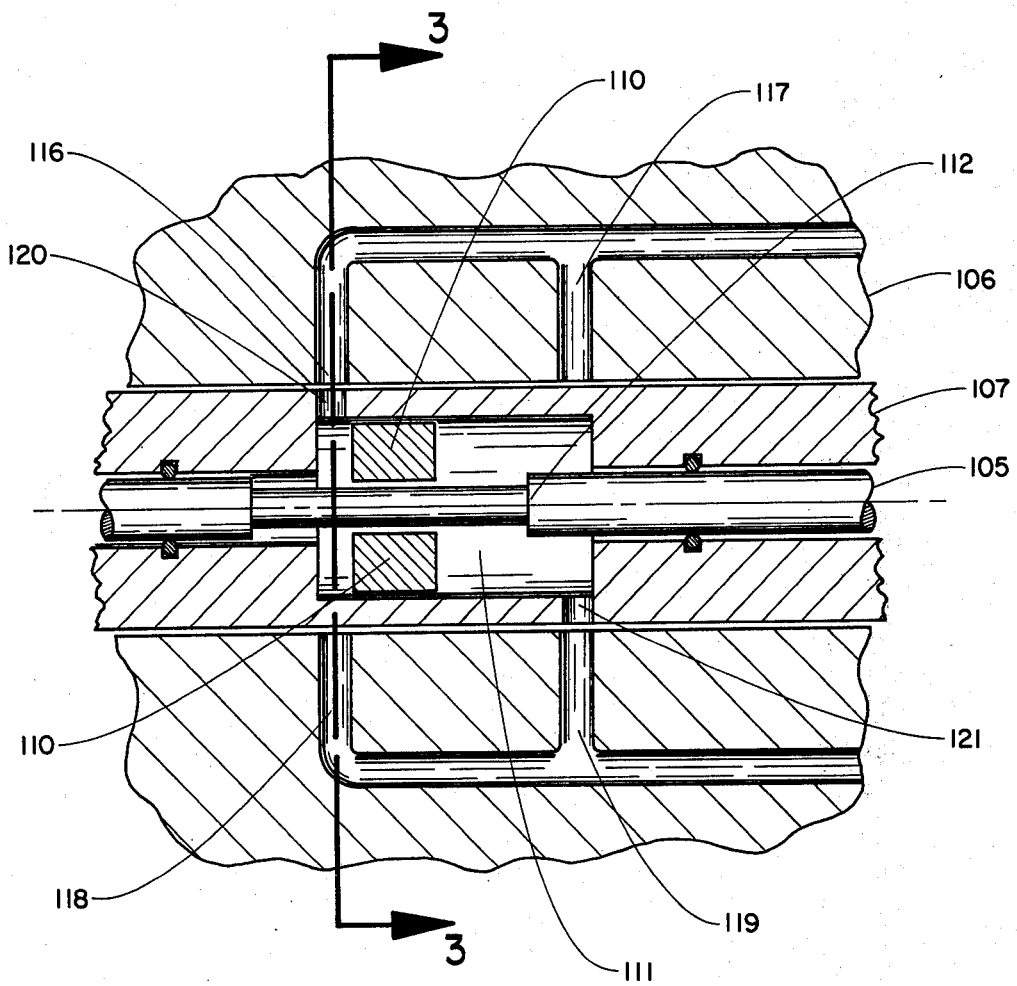
In FIG. 2 is shown, in greater detail, a rotating port element, 107, a fixed port element, 106, a free piston element, 110, and a piston stop bar, 105, of a variable stroke, positive displacement flow regulator, 12.
Figure 3:
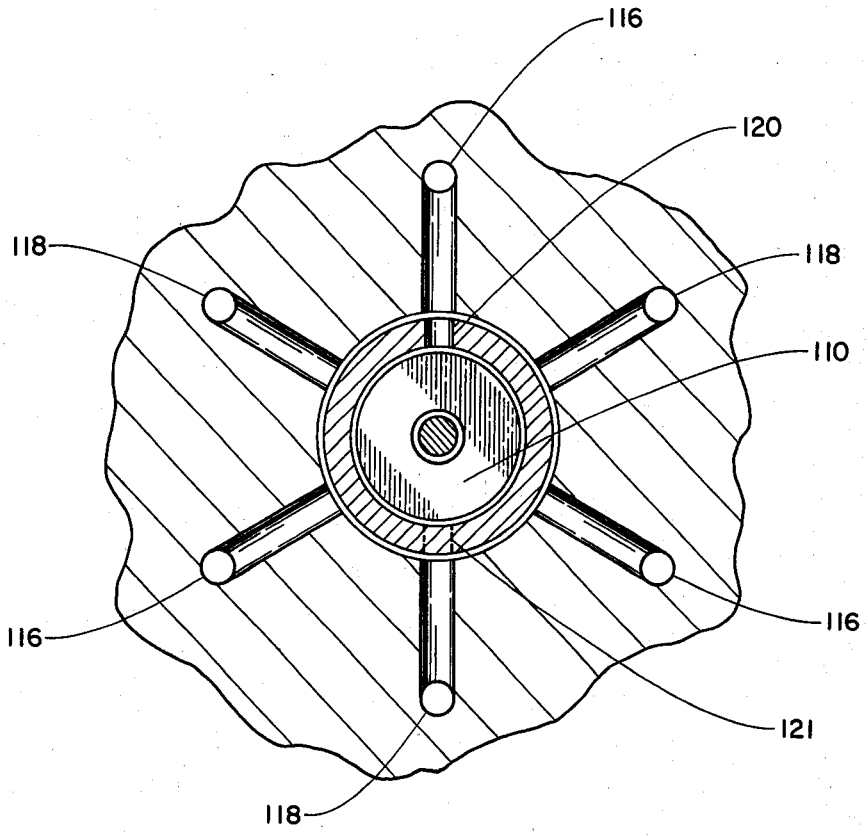
In FIG. 3 is shown the cross sectional view, 3—3, of FIG. 2, to illustrate one arrangement of some of the fixed ports, 116, and the moving ports, 120, of a variable stroke, positive displacement flow regulator, 12.

One moving port, 120, connects always into one end of the closed end cylinder, 111, and thus to one side of the free piston, 110, whereas the other moving port, 121, connects always into the other end of the closed end cylinder, 111, and thus to the other side of the free piston, 110. In FIGS. 1, 2 and 3 the free piston, 110, and its closed end cylinder, 111, are shown contained within the rotating port element, 107, but this is not necessary and the free piston and its cylinder can be separate and non rotating provided that the moving ports connect thereto as described above.

An example of an arrangement of fixed and moving ports fulfilling the foregoing requirements is shown in FIGS. 2 and 3, FIG. 3 being the cross section, 3—3, of FIG. 2 to show an angular distribution of one set of coplanar pressure fixed ports, 116, and the coplanar set of discharge fixed ports, 118, and of the moving ports, 120, and, 121. The three coplanar pressure fixed ports, 116, are uniformly displaced angularly by 120° about the axis of rotation of the rotating port element, 107, as are also the three coplanar discharge fixed ports, 118, and these latter are angularly displaced by 60° from the coplanar pressure fixed ports, 116. The moving ports, 120 and 121, are separated angularly about the axis of rotation of the rotating port element, 107, by a displacement angle of 180°. Hence the other coplanar set of pressure fixed ports, 117, and discharge fixed ports, 119, are disposed angularly about the axis of rotation of the rotating port element, 107, in exactly the same alignment as shown in FIG. 3. Thus when the moving port, 120, is indexed with the pressure fixed port, 116, the moving port, 121, is indexed with a discharge fixed port, 119, as shown in FIGS. 3 and 2.

The operation of the particular form of this invention shown in FIGS. 1, 2 and 3 can be described as follows during the closing of the engine intake valve, 11. At the usual intake valve closing time of engine piston at or near bottom dead center at the end of the intake stroke, the intake valve cam moves the rocker arm, 14, away from the engine intake valve, 11, and the valve spring, 15, applies a force to the valve, 11, in a direction to close the valve, 11. As the engine intake valve, 11, commences to close the one way check valve, 18, closes and, as a result, the force of the valve spring, 15, acts via the dashpot piston, 17, to create a pressure in the dashpot fluid contained in the rocker arm end, 102, of the dashpot cylinder, 16. This dashpot fluid pressure acts via the control passage connection, 103, at the pressure fixed ports, 116 and 117, of the variable stroke, positive displacement flow regulator, 12. When the moving port, 120, indexes with a pressure fixed port, 116, the dashpot fluid pressure forces the free piston, 110, to move away from the moving port, 120, and such motion of the free piston, 110, will continue until the piston, 110, comes to rest against the shoulder, 112, of the piston stop bar, 105. During this motion of the free piston, 110, the other moving port, 121, was indexed with a discharge fixed port, 119, and the dashpot fluid on that side of the free piston, 110, toward the moving port, 121, will move via the control passage connection, 104, into the valve side, 101, of the dashpot cylinder, 16. As a result of this single motion of the free piston, 110, a net volume of dashpot fluid has been transferred from the rocker arm side, 102, of the dashpot cylinder, 16, to the valve side, 101, and the intake valve, 11, can thus move in the closing direction an amount equal to the ratio of the transferred volume to the effective area of the dashpot piston, 17. The net volume of dashpot fluid thus transferred for a single motion of the free piston, 110, is equal to the product of the effective area of the free piston, 110, times the length of stroke allowed to the free piston by the piston stop bar, 105. The continued rotation of the rotating port element, 107, causes the moving port, 121, to next index with a pressure fixed port and the moving port, 120, to simultaneously next index with a discharge fixed port and, as a result, the free piston, 110, is moved by the dashpot fluid pressure away from the port, 121, and toward the port, 120, until the free piston, 110, comes to rest against the fixed stop of the end of the cylinder, 111. This return motion of the free piston, 110, has again caused the transfer of the same net volume of dashpot fluid from the rocker arm side, 102, to the valve side, 101, of the dashpot cylinder, 16. In this way, the back and forth motion of the free piston, 110, caused by successive indexings of the moving ports, 120 and 121, resulting from rotation of the rotating port element, 107, causes the engine intake valve, 11, to close in a series of steps. The size of each such step of intake valve closure can be increased by moving the piston stop bar, 105, to allow a longer stroke of the free piston, 110. Since the engine intake valve, 11, has a fixed distance to move from fully open to fully closed, such increase of the size of each step of valve closure must cause the engine intake valve, 11, to fully close at an earlier engine piston position, the rotation of the rotating port element, 107, and hence the number of indexings of moving ports, 120 and 121, alternately with pressure fixed ports, 116 and 117, and with discharge fixed ports, 118 and 119, being fixed in relation to engine piston motion by the drive gears, 108 and 109. Thus the engine piston position at which the intake valve closes fully is the same at all speeds of the engine for any one setting of the piston stop bar, 105. By moving the piston stop bar, 105, via the torque control linkage, 113, to increase the length of stroke of the free piston, 110, the engine intake valve will be fully closed with the engine piston earlier into the return compression stroke, and less air-fuel mixture thus having been returned into the engine intake manifold, more will be trapped within the engine cylinder and the engine torque will be increased. Engine torque may thus be controlled by control of the stroke of the free piston, 110, via the piston stop bar, 105, and the torque control linkage, 113. At any one setting of the piston stop bar, 105, the engine piston position at intake valve closure is the same at all engine speeds and thus this engine torque is independent of engine speed. It is in this way that the first principal beneficial object of this invention is achieved, to make available the several beneficial objects of the earlier cross referenced application with an engine torque characteristic essentially constant with engine speed at any setting of the torque control linkage, 113.

So that the full torque capability of the engine can be realized, the maximum stroke of the free piston, 110, achieved when the piston stop bar is positioned by the full control stop, 114, should be sufficient to allow the engine intake valve, 11, to close essentially as rapidly as the intake valve cam will allow. This requirement can be met by relating: the displacement volume, VD, of one full stroke of the dashpot element, 10, defined as the product of the effective area of the dashpot piston, 17, times the intake valve lift; the displacement volume of one full stroke of the free piston, VP, defined as the product of the effective area of the free piston, 110, times the maximum available stroke of the free piston as set by the full control stop, 114; the total number of pressure fixed ports, *n*, in the fixed port element, 106; the revolutions per minute, NR, of the rotating port element, 107; the revolutions per minute of the engine crankshaft, NE; and the minimum intake valve closing angle, AM, in crankshaft radians; according to the following equation.

$$(VP)(n)(NR/NE)(AM) = 6.283(VD)$$

The speed ratio, *NR/NE*, is determined by the tooth ratio of the gears, 108 and 109, which drive the rotating port element, 107, from the engine camshaft, 13, or engine crankshaft if desired. The minimum intake valve closing angle, AM, should be at least as small as the intake valve closing angle, AC, of the intake cam on the engine camshaft in crankshaft radians, and is preferably less than AC, so that, at full engine torque, the engine intake valve, 11, follows the rocker arm, 14, during closure.

The engine intake valve, 11, must eventually close and this should occur prior to the firing of the ignition spark within the engine cylinder to avoid backfiring of the air-fuel mixture. The idle control stop, 115, positions the piston stop bar, 105, at the minimum stroke of the free piston, 110, and this minimum displacement volume of one stroke of the free piston is termed the idle displacement volume, VI, and defined as the product of the effective area of the free piston, 110, times the minimum stroke of the free piston as set by the idle control stop, 115. This requirement to avoid backfiring can be met by determining the idle displacement volume, VI, according to the following equation:

$$VI = VP\left(\frac{AM}{AX}\right)$$

wherein the maximum intake valve closing angle, *AX*, is equal to the minimum intake valve closing angle, *AM*, plus three radians minus the maximum engine ignition spark advance in crankshaft radians before engine piston top dead center.

A multicylinder, four stroke cycle, gasoline engine will require one variable stroke, positive displacement, flow regulator, as described above, for each cylinder of the engine. It is desirable that the several piston stop bars, 105, of these several flow regulators be positioned for equal free piston stroke length at each setting of the engine torque control linkage, 113, to secure equal work load in each cylinder of the engine. This balanced load condition between engine cylinders can be achieved by fastening all of the several piston stop bars together at the same free piston stroke length setting and connecting the engine torque control linkage to this assembled multiple piston stop bar. Alternatively each of the several piston stop bars may be secured individually to the torque control linkage the several piston stop bars being secured thusly at the same free piston stroke length setting.

To achieve the second principal object of this invention a variable stroke, positive displacement flow regulator, 12, is connected to a dashpot element, 10, via control passage, 103 and 104, as described above and, additionally the adjustable flow restrictor described in the earlier cross referenced application also connects between the two chambers, 101 and 102, of the dashpot element, 10. Additionally the engine torque control linkage, 113, connects only to the piston stop bar, 105, and is connected from the adjustable flow restrictor. The adjustment of the adjustable flow restrictor can be set and fixed at any setting between maximum flow restriction and minimum flow restriction and in consequence the engine torque characteristic will correspondingly vary from almost constant torque with changing engine speed to sharply rising torque with decreasing engine speed, as explained hereinafter.

The variable stroke, positive displacement flow regulator, 12, operates at any one setting of the piston stop bar, 105, in the same manner as described hereinabove to allow dashpot fluid to flow from chamber, 102, to chamber, 101, at a rate proportional to engine speed. The adjustable flow restrictor operates, at any one setting thereof, to allow dashpot fluid to flow from chamber, 102, to chamber, 101, at a rate independent of engine speed. Thus, at fixed settings of the piston stop bar and the adjustable flow restrictor, as engine speed decreases an increasing portion of the dashpot fluid returns via the adjustable flow restrictor path and the engine intake valve, 11, closes sooner on the engine piston return stroke following the intake stroke. Hence more air-fuel mixture remains inside the engine cylinder at intake valve closure and engine torque is increased as engine speed is decreased. The extent of such torque increase with engine speed decrease can be adjusted by adjustment of the adjustable flow restrictor. At maximum flow restriction of the adjustable flow restrictor, very little of the dashpot fluid returns via the adjustable flow restrictor, most of the dashpot fluid returns via the variable stroke, positive displacement flow regulator and the engine torque increases very little as engine speed decreases. At minimum flow restriction of the adjustable flow restrictor, an appreciable portion of the dashpot fluid returns via the adjustable flow restrictor, but an appreciable portion of the dashpot fluid still returns via the variable stroke, positive displacement flow regulator so that torque control can be retained, and the engine torque increases appreciably as engine speed decreases. Thus the variation of engine torque with engine speed may be adjusted between the above limits by adjustment of the adjustable flow restrictor and it is in this way that the second principal object of this invention is achieved.

Having thus described my invention what I claim as new and desire to secure by Letters Patent is:

1. The combination of a four stroke cycle gasoline engine, complete with engine intake valves, intake valve closing springs, intake valve operating cams and linkage, and additionally fitted with a dashpot connecting between each such engine intake valve and the frame of the engine, wherein the improvement comprises connecting the two chambers of each such dashpot together via a variable stroke, positive displacement flow regulator;

said variable stroke, positive displacement, flow regulator comprising a fixed port element, a rotating port element and drive, a free piston element, a piston stop bar and torque control linkage;

said fixed port element being secured to the engine frame and containing a cavity, within which the rotating port element rotates, and having two groups of fixed ports; one group of fixed ports, the pressure fixed ports, being connected together and jointly connecting via a portion of the control passage to one chamber of the dashpot, these pressure fixed ports connecting into the cavity in two sets of pressure fixed ports, each such set being coplanar in a plane at right angles to the axis of rotation of the rotating port element, the plane containing the one set of pressure fixed ports being displaced axially along said axis of rotation from the plane containing the other set of pressure fixed ports by a distance sufficient for sealing therebetween, the pressure fixed ports of each such set being angularly displaced relative to each other about said axis of rotation, the number of such pressure fixed ports in each set of the two sets being an integral odd number; the other group of fixed ports, the discharge fixed ports, being connected together and jointly connecting via the other portion of the control passage to the opposite chamber of the dashpot, these discharge fixed ports connecting into the cavity in two sets of discharge fixed ports, each such set being coplanar in a plane at right angles to the axis of rotation of the rotating port element, these two planes containing these two sets of discharge fixed ports being coincident with the two planes containing the two sets of pressure fixed ports, the discharge fixed ports of each such set being angularly displaced relative to each other and each such discharge fixed port being displaced 180° from one of the coplanar pressure fixed ports about said axis of rotation, the number of such discharge fixed ports in each set of the two sets being equal to the number of pressure fixed ports with which they are coplanar, each pressure fixed port of one coplanar set of pressure and discharge fixed ports being angularly displaced from one discharge fixed port of the other coplanar set of pressure and discharge fixed ports by the displacement angle between the rotating ports as described hereinafter;

said rotating port element being positively rotated, within the cavity in the fixed port element, as by gears or chains, from an engine shaft such as the crankshaft or camshaft, said rotating port element being closely and sealably fitted to the cavity in the fixed port element; said rotating port element being fitted with two passages, each such passage being fitted with two ports at its ends, one such port of one such passage indexing with and being always coplanar with one set of coplanar pressure and discharge fixed ports in the fixed port element the other port of this same passage connecting always to one end of the free piston element as described hereinafter, one such port of the other passage indexing with and being always coplanar with the other set of coplanar pressure and discharge fixed ports in the fixed port element the other port of this latter passage connecting always to the other end of the free piston element, said two rotating ports which index with and are coplanar with the pressure and discharge fixed ports being angularly displaced from one another about the axis of rotation of the rotating port element by the displacement angle which can have any value between zero and 180°; said rotating port element being axially held in alignment within the cavity in the fixed port element so that the rotating ports index with and remain coplanar with the sets of pressure fixed ports and discharge fixed ports;

said free piston element being a free piston and closed ended cylinder with the free piston fitted closely and moveably within the cylinder and being free to move within said cylinder except as limited by the piston stop bar, one end of said cylinder connecting always into one passage in the rotating port element and the other end of said cylinder connecting always into the other passage in the rotating port element, the closed ends of said cylinder being fitted with holes for the piston stop bar and these two stop bar holes are straight and parallel to the axis of the cylinder;

said piston stop bar comprising two portions fitted closely, sealably and moveably into the two holes in the closed ends of the cylinder of the free piston element and both portions being of equal cross sectional area less than the cross sectional area of the cylinder, these two portions of the piston stop bar being connected positively together so as to move together, at least one such portion being moveable into the cylinder of the free piston element and to thus limit the motion of the free piston within this cylinder, said piston stop bar being fitted with two control stops which limit the range of motion of the piston stop bar, one of these control stops the full control stop is placed on the piston stop bar so that when the piston stop bar is against this full control stop the free piston is free to move through its full displacement volume in each direction before being stopped by the cylinder end or the piston stop bar, the other control stop the idle control stop is placed on the piston stop bar so that when the piston stop bar is against this idle control stop one portion of the piston stop bar extends into the cylinder a distance which will produce a free piston active displacement volume equal to the idle displacement volume as defined hereinafter, said piston stop bar being moveable to any position between the two positions set by the two control stops via a torque control linkage connected to said piston stop bar;

the displacement volume of one full stroke of the dashpot, VD, the displacement volume of one full stroke of the free piston, VP, the total number of pressure fixed ports in the fixed port element, $n$, the revolutions per minute of the rotating port element, NR, the revolutions per minute of the engine, NE, are necessarily related to one another and to the minimum intake valve closing angle, AM, in crankshaft radians, according to the following equations:

$$(VP)(n)(NR/NE)(AM) = (6.283)(VD)$$

wherein the speed ratio, $NR/NE$, is determined by the positive drive mechanism driving the rotating port element from the engine shaft, the minimum intake valve closing angle, $AM$, is at least as small as the intake valve closing angle in crankshaft radians of the intake cams on the engine camshaft, $AC$, and is preferably less than AC up to as small as one half of AC; the idle displacement volume of one active stroke of the free piston, $VI$, is determined by the following equation:

$$VI = (VP)\left(\frac{AM}{AX}\right)$$

wherein the maximum intake valve closing angle, $AX$, is equal to the minimum intake valve closing angle, $AM$, plus 3 radians minus the maximum engine ignition spark advance in crankshaft radians before piston top dead center;

on multicylinder gasoline engines the several piston stop bars of the several variable stroke, positive displacement, flow regulators being connected to the torque control linkage with equal free piston stroke length.

2. The combination of a four stroke cycle gasoline engine, complete with engine intake valves, intake valve closing springs, intake valve operating cams and linkage, and additionally fitted with a dashpot connecting between each such engine intake valve and the frame of the engine, the two chambers of each such dashpot connecting together via an adjustable flow restrictor, wherein the improvement comprises connecting the two chambers of each such dashpot together also via a variable stroke, positive displacement, flow regulator and disconnecting the engine torque control linkage from said adjustable flow restrictor;

said variable stroke, positive displacement, flow regulator comprising a fixed port element, a rotating port element and drive, a free piston element, a piston stop bar and torque control linkage;

said fixed port element being secured to the engine frame and containing a cavity, within which the rotating port element rotates, and having two groups of fixed ports; one group of fixed ports, the pressure fixed ports, being connected together and jointly connecting via a portion of the control passage to one chamber of the dashpot, these pressure fixed ports connecting into the cavity in two sets of pressure fixed ports, each such set being coplanar in a plane at right angles to the axis of rotation of the rotating port element, the plane containing the one set of pressure fixed ports being displaced axially along said axis of rotation from the plane containing the other set of pressure fixed ports by a distance sufficient for sealing therebetween, the pressure fixed ports of each such set being angularly displaced relative to each other about said axis of rotation, the number of such pressure fixed ports in each set of the two sets being an integral odd number; the other group of fixed ports, the discharge fixed ports, being connected together and jointly connecting via the other portion of the control passage to the opposite chamber of the dashpot, these discharge fixed ports connecting into the cavity in two sets of discharge fixed ports, each such set being coplanar in a plane at right angles to the axis of rotation of the rotating port element, these two planes containing these two sets of discharge fixed ports being coincident with the two planes containing the two sets of pressure fixed ports, the discharge fixed ports of each such set being angularly displaced relative to each other and each such discharge fixed port being displaced 180° from one of the coplanar pressure fixed ports about said axis of rotation, the number of such discharge fixed ports in each set of the two sets being equal to the number of pressure fixed ports with which they are coplanar, each pressure fixed port of one coplanar set of pressure and discharge fixed ports being angularly displaced from one discharge fixed port of the other coplanar set of pressure and discharge fixed port by the displacement angle between the rotating ports as described hereinafter, said rotating port element being positively rotated, within the cavity in the fixed port element, as by gears or chains, from an engine shaft such as the crankshaft or camshaft, said rotating port element being closely and sealably fitted to the cavity in the fixed port element; said rotating port element being fitted with two passages, each such passage being fitted with two ports at its ends, one such port of one such passage indexing with and being always coplanar with one set of coplanar pressure and discharge fixed ports in the fixed port element the other port of this same passage connecting always to one end of the free piston element as described hereinafter, one such port of the other passage indexing with and being always coplanar with the other set of coplanar pressure and discharge fixed ports in the fixed port element the other port of this latter passage connecting always to the other end of the free piston element, said two rotating ports which index with and are coplanar with the pressure and discharge fixed ports being angularly displaced from one another about the axis of rotation of the rotating port element by the displacement angle which can have any value between zero and 180°; said rotating port element being axially held in alignment within the cavity in the fixed port element so that the rotating ports index with and remain coplanar with the sets of pressure fixed ports and discharge fixed ports;

said free piston element being a free piston and closed ended cylinder with the free piston fitted closely and moveably within the cylinder and being free to move within said cylinder except as limited by the piston stop bar, one end of said cylinder connecting always into one passage in the rotating port element and the other end of said cylinder connecting always into the other passage in the rotating port element, the closed ends of said cylinder being fitted with holes for the piston stop bar and these two stop bar holes are straight and parallel to the axis of the cylinder;

said piston stop bar comprising two portions fitted closely, sealably and moveably into the two holes in the closed ends of the cylinder of the free piston element and both portions being of equal cross sectional area less than the cross sectional area of the cylinder, these two portions of the piston stop bar being connected positively together so as to move together, at least one such portion being moveable into the cylinder of the free piston element and to thus limit the motion of the free piston within this cylinder, said piston stop bar being fitted with two control stops which limit the range of motion of the piston stop bar, one of these control stops the full control stop is placed on the piston stop bar so that when the piston stop bar is against this full control stop the free piston is free to move through its full displacement volume in each direction before being stopped by the cylinder end or the piston stop bar, the other control stop the idle control stop is placed on the piston stop bar so that when the piston stop bar is against this idle control stop one portion of the piston stop bar extends into the cylinder a distance which will produce a free piston active displacement volume equal to the idle displacement volume as defined hereinafter, said piston stop bar being moveable to any position between the two positions set by the two control stops via a torque control linkage connected to said piston stop bar;

the displacement volume of one full stroke of the dashpot, VD, the displacement volume of one full stroke of the free piston, VP, the total number of pressure fixed ports in the fixed port element, $n$, the revolutions per minute of the rotating port element, NR, the revolutions per minute of the engine, NE, are necessarily related to one another and to the minimum intake valve closing angle, A, in crankshaft radians, according to the following equation;

$$(VP)(n)(NR/NE)(AM) = (6.283)(VD)$$

wherein the speed ratio, $NR/NE$, is determined by the positive drive mechanism driving the rotating port element from the engine shaft, the minimum intake valve closing angle, $AM$, is at least as small as the intake valve closing angle in crankshaft radians of the intake cam on the engine camshaft, $AC$, and is preferably less than AC up to as small as one half of AC; the idle displacement volume of one active stroke of the free piston, $VI$, is determined by the following equation;

$$VI = (VP)\left(\frac{AM}{AX}\right)$$

wherein the maximum intake valve closing angle, AX, is equal to the minimum intake valve closing angle, AM, plus 3 radians minus the maximum engine ignition spark advance in crankshaft radians before piston top dead center;

on multicylinder gasoline engines the several piston stop bars of the several variable stroke, positive displacement, flow regulators being connected to the torque control linkage with equal free piston stroke length.

3. The combination of a four stroke cycle gasoline engine, complete with engine intake valves, intake valve closing springs, intake valve operating cams and linkage, and additionally fitted with a dashpot connecting between each such engine intake valve and the frame of the engine, wherein the improvement comprises connecting the two chambers of each such dashpot together via a variable stroke, positive displacement flow regulator;

said variable stroke, positive displacement, flow regulator comprising a fixed port element, a rotating port element and drive, a free piston element, a piston stop bar and torque control linkage;

said fixed port element being secured to the engine frame and containing a cavity, within which the rotating port element rotates, and having two groups of fixed ports; one group of fixed ports, the pressure fixed ports, being connected together and jointly connecting via a portion of the control passage to that chamber of the dashpot whose volume is decreased when the engine intake valve closes, these pressure fixed ports connecting into the cavity in two sets of pressure fixed ports, each such set being coplanar in a plane at right angles to the axis of rotation of the rotating port element, the plane containing the one set of pressure fixed ports being displaced axially along said axis of rotation from the plane containing the other set of pressure fixed ports by the axial distance separating the two moving ports in the rotating port element, the pressure fixed ports of each such set being equally angularly displaced relative to each other about said axis of rotation and such that each pressure fixed port of one set is coplanar with a pressure fixed port of the other set in a plane containing said axis of rotation and both these axially coplanar pressure fixed ports are on the same side of the axis of rotation, the number of such pressure fixed ports in each set of the two sets being an integral odd number; the other group of fixed ports, the discharge fixed ports, being connected together and jointly connecting via the other portion of the control passage to that chamber of the dashpot whose volume is increased when the engine intake valve closes, these discharge fixed ports connecting into the cavity in two sets of discharge fixed ports, each such set being coplanar in a plane at right angles to the axis of rotation of the rotating port element, these two planes containing these two sets of discharge fixed ports being coincident with the two planes containing the two sets of pressure fixed ports, the discharge fixed ports of each such set being equally angularly displaced relative to each other and also relative to the coplanar pressure fixed ports about said axis of rotation and such that each discharge fixed port of one set is coplanar with a discharge fixed port of the other set in a plane containing said axis of rotation and both of these axially coplanar discharge fixed ports are on the same side of the axis of rotation, the number of such discharge fixed ports in each set of the two sets being equal to the number of pressure fixed ports with which they are coplanar;

said rotating port element containing a cylindrical cavity for the free piston element and being fitted with two rotating ports connecting each end of said cylindrical cavity, and containing a passage for the piston stop bar, said rotating port element being positively rotated, within the cavity in the fixed port element, as by gears or chains, from an engine shaft such as the crankshaft or camshaft, said rotating port element being closely and sealably fitted to the cavity in the fixed port element; said two rotating ports being jointly coplanar with a plane containing the axis of rotation of the rotating port element and being on opposite sides of said axis of rotation, these two rotating ports being separated from one another along the axis of rotation a distance sufficient to seal them from one another and preferably about the length of the cylindrical cavity; said rotating port element being axially held in alignment within the cavity in the fixed port element so that one of the rotating ports indexes with and is coplanar with one of the sets of pressure fixed ports and also that the set of discharge fixed ports which is coplanar therewith, and also so that the other rotating port indexes with and is coplanar with the other set of pressure fixed ports and also that other set of discharge fixed ports which is coplanar therewith, said passage for the piston stop bar being cylindrical and coaxial with the axis of rotation of the rotating port element, the centerline of said cylindrical cavity being coaxial with the axis of rotation of the rotating port element;

said free piston element being a piston fitted closely but moveably within the cylindrical cavity in the rotating port element and containing a cylindrical passage coaxial with the axis of rotation of the rotating port element, said cylindrical passage in the free piston element being of a diameter smaller than the diameter of the cylindrical passage for the piston stop bar in the rotating port element;

said piston stop bar being fitted closely, sealably and moveably into the cylindrical passage in the rotating port element and having a reduced diameter portion which is fitted closely and moveably to the cylindrical passage in the free piston element, the length of said reduced diameter portion being at least as long as the length of the cylindrical cavity for the free piston within the rotating port element, said piston stop bar being axially moveable along the axis of rotation of the rotating port element and being fitted with two control stops which limit the range of such motion of the piston stop bar, one of these control stops the full control stop is placed on the piston stop bar so that when the piston stop bar is against this full control stop the reduced diameter portion of the piston stop bar is located along the entire length of the cylindrical cavity for the free piston within the rotating port element, the other control stop the idle control stop is placed on the piston stop bar so that when the piston stop bar is against this idle control stop the reduced diameter portion of the piston stop bar is located along only that portion of the length of the cylindrical cavity which will produce a free piston active displacement volume equal to the idle displacement volume as defined hereinafter, said piston stop bar being moveable to any position between the two positions set by the two control stops via a torque control linkage connected moveably with respect to rotation but axially immoveably to said piston stop bar;

the displacement volume of one full stroke of the dashpot, VD, the displacement volume of one full stroke of the free piston, VP, the total number of pressure fixed ports in the fixed port element, $n$, the revolutions per minute of the rotating port element, NR, the revolutions per minute of the engine, NE, are necessarily related to one another and to the minimum intake valve closing angle, Am, in crankshaft radians, according to the following equation:

$$(VP)(n)(NR/NE)(AM) = (6.283)(VD)$$

wherein the speed ratio, $NR/NE$, is determined by the positive drive mechanism driving the rotating port element from the engine shaft, the minimum intake valve closing angle, $AM$, is at least as small as the intake valve closing angle in crankshaft radians of the intake cam on the engine camshaft, $AC$, and is preferably less than AC up to as small as one half of AC; the idle displacement volume of one active stroke of the free piston, $VI$, is determined by the following equation;

$$VI = (VP)\left(\frac{AM}{AX}\right)$$

wherein the maximum intake valve closing angle, $AX$, is equal to the minimum intake valve closing angle, $AM$, plus 3 radians minus the maximum engine ignition spark advance in crankshaft radians before piston top dead center;

on multicylinder gasoline engines the several piston stop bars of the several variable stroke, positive displacement, flow regulators being connected to the torque control linkage with equal free piston stroke length.

4. The combination of a four stroke cycle gasoline engine, complete with engine intake valves, intake valve closing springs, intake valve operating cams and linkage, and additionally fitted with a dashpot connecting between each such engine intake valve and the frame of the engine, the two chambers of each such dashpot connecting together via an adjustable flow restrictor, wherein the improvement comprises connecting the two chambers of each such dashpot together also via a variable stroke, positive displacement, flow regulator and disconnecting the engine torque control linkage from said adjustable flow restrictor;

said variable stroke, positive displacement flow regulator comprising a fixed port element, a rotating port element and drive, a free piston element, a piston stop bar and torque control linkage;

said fixed port element being secured to the engine frame and containing a cavity, within which the rotating port element rotates, and having two groups of fixed ports; one group of fixed ports, the pressure fixed ports, being connected together and jointly connecting via a portion of the control passage to that chamber of the dashpot whose volume is decreased when the engine intake valve closes, these pressure fixed ports connecting into the cavity in two sets of pressure fixed ports, each such set being coplanar in a plane at right angles to the axis of rotation of the rotating port element, the plane containing the one set of pressure fixed ports being displaced axially along said axis of rotation from the plane containing the other set of pressure fixed ports by the axial distance separating the two moving ports in the rotating port element, the pressure fixed ports of each such set being equally angularly displaced relative to each other about said axis of rotation and such that each pressure fixed port of one set is coplanar with a pressure fixed port of the other set in a plane containing said axis of rotation and both these axially coplanar pressure fixed ports are on the same side of the axis of rotation, the number of such pressure fixed ports in each set of the two sets being an integral odd number; the other group of fixed ports, the discharge fixed ports, being connected together and jointly connecting via the other portion of the control passage to that chamber of the dashpot whose volume is increased when the engine intake valve closes, these discharge fixed ports connecting into the cavity in two sets of discharge fixed ports, each such set being coplanar in a plane at right angles to the axis of rotation of the rotating port element, these two planes containing these two sets of discharge fixed ports being coincident with the two planes containing the two sets of pressure fixed ports, the discharge fixed ports of each such set being equally angularly displaced relative to each other and also relative to the coplanar pressure fixed ports about said axis of rotation and such that each discharge fixed port of one set is coplanar with a discharge fixed port of the other set in a plane containing said axis of rotation and both of these axially coplanar fixed ports are on the same side of the axis of rotation, the number of such discharge fixed ports in each set of the two sets being equal to the number of pressure fixed ports with which they are coplanar;

said rotating port element containing a cylindrical cavity for the free piston element and being fitted with two rotating ports connecting to each end of said cylindrical cavity, and containing a passage for the piston stop bar, said rotating port element being positively rotated, within the cavity in the fixed port element, as by gears or chains, from an engine shaft such as the crankshaft or camshaft, said rotating port element being closely and sealably fitted to the cavity in the fixed port element; said two rotating ports being jointly coplanar with a plane containing the axis of rotation of the rotating port element and being on opposite sides of said axis of rotation, these two rotating ports being separated from one another along the axis of rotation a distance sufficient to seal them from one another and preferably about the length of the cylindrical cavity; said rotating port element being axially held in alignment within the cavity in the fixed port element so that one of the rotating ports indexes with and is coplanar with one of the sets of pressure fixed ports and also that set of discharge fixed ports which is coplanar therewith, and also so that the other rotating port indexes with and is coplanar with the other set of pressure fixed ports and also that other set of discharge fixed ports which is coplanar therewith, said passage for the piston stop bar being cylindrical and coaxial with the axis of rotation of the rotating port element, the centerline of said cylindrical cavity being coaxial with the axis of rotation of the rotating port element;

said free piston element being a piston fitted closely but moveably within the cylindrical cavity in the rotating port element and containing a cylindrical passage coaxial with the axis of rotation of the rotating port element, said cylindrical passage in the free piston element being of a diameter smaller than the diameter of the cylindrical passage for the piston stop bar in the rotating port element;

said piston stop bar being fitted closely, sealably and moveably into the cylindrical passage in the rotating port element and having a reduced diameter portion which is fitted closely and moveably to the cylindrical passage in the free piston element, the length of said reduced diameter portion being at least as long as the length of the cylindrical cavity for the free piston within the rotating port element, said piston stop bar being axially moveable along the axis of rotation of the rotating port element and being fitted with two control stops which limit the range of such motion of the piston stop bar, one of these control stops the full control stop is placed on the piston stop bar so that when the piston stop bar is against this full control stop the reduced diameter portion of the piston stop bar is located along the entire length of the cylindrical cavity for the free piston within the rotating port element, the other control stop the idle control stop is placed on the piston stop bar so that when the piston stop bar is against this idle control stop the reduced diameter portion of the piston stop bar is located along only that portion of the length of the cylindrical cavity which will produce a free piston active displacement volume equal to the idle displacement volume as defined hereinafter, said piston stop bar being moveable to any position between the two positions set by the two control stops via a torque control linkage connected moveably with respect to rotation but axially immoveably to said piston stop bar;

the displacement volume of one full stroke of the dashpot, VD, the displacement volume of one full stroke of the free piston, VP, the total number of pressure fixed ports in the fixed port element, $n$, the revolutions per minute of the rotating port element, NR, the revolutions per minute of the engine, NE, are necessarily related to one another and to the minimum intake valve closing angle, AM, in crankshaft radians, according to the following equation;

$$(VP)(n)(NR/NE)(AM) = (6.283)(VD)$$

wherein the speed ratio, $NR/NE$, is determined by the positive drive mechanism driving the rotating port element from the engine shaft, the minimum intake valve closing angle, $AM$, is at least as small as the intake valve closing angle in crankshaft radians of the intake cam on the engine camshaft $AC$, and is preferably less than AC up to as small as one half of AC; the idle displacement volume of one active stroke of the free piston, $VI$, is determined by the following equation;

$$VI = (VP)\left(\frac{AM}{AX}\right)$$

wherein the maximum intake valve closing angle, AX, is equal to the minimum intake valve closing angle, AM, plus 3 radians minus the maximum engine ignition spark advance in crankshaft radians before piston top dead center;

on multicylinder gasoline engines the several piston stop bars of the several variable stroke, positive displacement, flow regulators being connected to the torque control linkage with equal free piston stroke length.

* * * * *